US007575129B2

(12) United States Patent
Yuyama et al.

(10) Patent No.: US 7,575,129 B2
(45) Date of Patent: Aug. 18, 2009

(54) VIAL SUPPLY APPARATUS

(75) Inventors: Shoji Yuyama, Toyonaka (JP); Katsunori Yoshina, Toyonaka (JP); Takafumi Imai, Toyonaka (JP); Masahito Miyashita, Toyonaka (JP)

(73) Assignee: Yuyama Mfg., Co., Ltd., Osaka (JP)

( * ) Notice: Subject to any disclaimer, the term of this patent is extended or adjusted under 35 U.S.C. 154(b) by 350 days.

(21) Appl. No.: 10/587,858

(22) PCT Filed: Jan. 20, 2005

(86) PCT No.: PCT/JP2005/000659

§ 371 (c)(1),
(2), (4) Date: Sep. 29, 2006

(87) PCT Pub. No.: WO2005/073089

PCT Pub. Date: Aug. 11, 2005

(65) Prior Publication Data

US 2007/0169437 A1 Jul. 26, 2007

(30) Foreign Application Priority Data

Jan. 30, 2004 (JP) ..... 2004-024888

(51) Int. Cl.
*B65H 31/20* (2006.01)

(52) U.S. Cl. ..... 221/241; 221/192; 221/304

(58) Field of Classification Search ..... None
See application file for complete search history.

(56) References Cited

U.S. PATENT DOCUMENTS 5,337,919 A * 8/1994 Spaulding et al. ..... 221/2
5,838,575 A * 11/1998 Lion ..... 700/231
5,946,883 A 9/1999 Yuyama et al.
6,115,996 A * 9/2000 Yuyama et al. ..... 53/411
7,210,598 B2 * 5/2007 Gerold et al. ..... 221/123
2002/0007868 A1 1/2002 Kodama et al.

FOREIGN PATENT DOCUMENTS

| | | |
|---|---|---|
| CA | 2 353 253 | 1/2002 |
| EP | 1 262 429 | 12/2002 |
| JP | 10-33636 | 2/1998 |
| JP | 2002-29511 | 1/2002 |
| JP | 2003-515514 | 5/2003 |
| WO | 01/40084 | 6/2001 |

* cited by examiner

*Primary Examiner*—Gene Crawford
*Assistant Examiner*—Timothy R Waggoner
(74) *Attorney, Agent, or Firm*—Wenderoth, Lind & Ponack, L.L.P.

(57) ABSTRACT

A vial supply apparatus comprises: a vial supply part having a plurality of storage portions which store vials having different heights according to size, each storage portion comprising a rotatable endless member disposed at a predetermined interval from a partition wall, partitioning members disposed at predetermined intervals on the endless member, endless member driving means, and a supply port for dispensing a vial stored between adjacent partitioning members; a chute portion for dropping the vial dispensed from the supply port such that an opening of the vial faces upward; a robot arm for holding the vial supplied from the chute portion; and an adjustment table disposed below the robot arm, for adjusting an opening height of the vial supplied from the chute portion in accordance with the height of the vial.

3 Claims, 16 Drawing Sheets

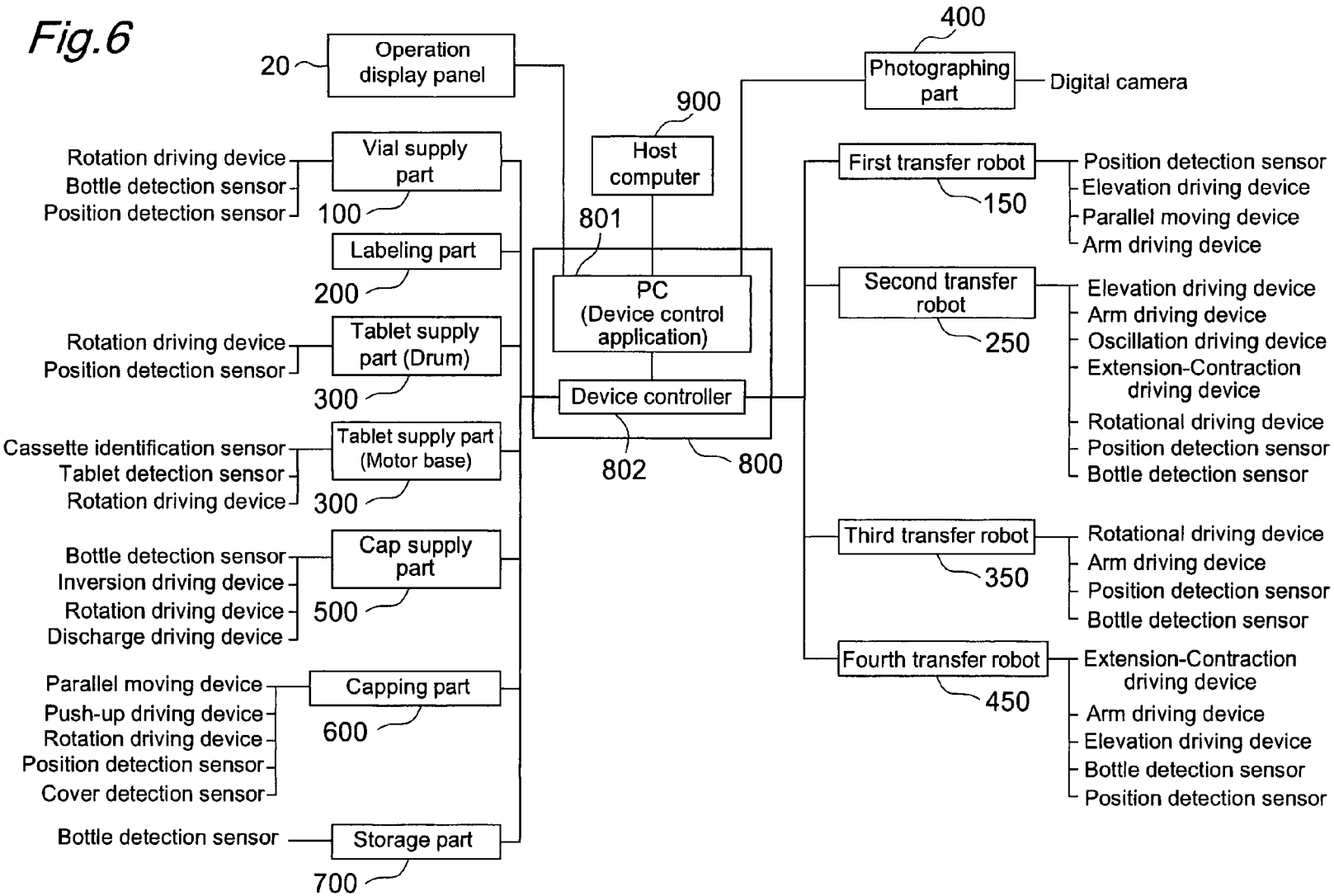
Fig.6
Operation display panel
20
Photographing part
400
Digital camera
Host computer
900
PC (Device control application)
801
Device controller
802
800
First transfer robot
150
Position detection sensor
Elevation driving device
Parallel moving device
Arm driving device
Second transfer robot
250
Elevation driving device
Arm driving device
Oscillation driving device
Extension-Contraction driving device
Rotational driving device
Position detection sensor
Bottle detection sensor
Third transfer robot
350
Rotational driving device
Arm driving device
Position detection sensor
Bottle detection sensor
Fourth transfer robot
450
Extension-Contraction driving device
Arm driving device
Elevation driving device
Bottle detection sensor
Position detection sensor
Vial supply part
100
Rotation driving device
Bottle detection sensor
Position detection sensor
Labeling part
200
Tablet supply part (Drum)
300
Rotation driving device
Position detection sensor
Tablet supply part (Motor base)
300
Cassette identification sensor
Tablet detection sensor
Rotation driving device
Cap supply part
500
Bottle detection sensor
Inversion driving device
Rotation driving device
Discharge driving device
Capping part
600
Parallel moving device
Push-up driving device
Rotation driving device
Position detection sensor
Cover detection sensor
Storage part
700
Bottle detection sensor

VIAL SUPPLY APPARATUS

FIELD OF THE INVENTION

The present invention relates to a vial supply apparatus in a tablet storing and dispensing apparatus.

DESCRIPTION OF RELATED ART

Prior art publication information relating to the vial supply apparatus of the present invention is as follow.

Japanese Unexamined Patent Application Publication H10-33636 discloses a tablet storing and dispensing apparatus comprising a vial storage portion, a vial dispensing portion, a vial erecting portion, an intermittent transport portion, an unsuitable vial removal portion, a medicine supply portion, a label affixing portion, a transparent sheet sealing portion, an envelope supply portion, and so on.

Of the components constituting the vial supply apparatus, the vial storage portion comprises a pair of partition walls extending in a vertical direction, and a storage portion storing vials in a vertically stacked fashion is formed between the partition walls, such that the bottom and opening of the vials are arranged alternately. A plurality of these storage portions are arranged in series to be capable of storing vials according to size, and a supply port is provided at the lower end of each storage portion. The supply port is provided with a stopper mechanism which prevents the vials from falling downward freely. The supply port is also provided with detection means for detecting the arrangement direction of the vials.

The vial dispensing portion comprises a sliding body which is capable of moving in a horizontal direction along the lower portion of the vial storage portion between the storage portions at two ends. A robot arm for gripping the vial is provided on the sliding body to be capable of advancing and retreating in the vertical direction and rotating in a front-rear direction.

The vial erecting device takes a vial from the vial dispensing portion, corrects the orientation of the vial, so that the opening of the vial faces upward, and supplies the vial to the intermittent transport portion.

The intermittent transport portion transports a vial that has been supplied to a predetermined first point to a second point by raising the vial, moving the vial horizontally, and then lowering the vial.

However, in this vial supply apparatus, the vials are arranged in the vial supply portion such that the bottoms and openings of the vials are positioned alternately. In so doing, a plurality of vials can be stacked with stability in each storage portion, but since the vial dispensing portion and vial erecting portion, both of which are constituted by complicated mechanisms, must be provided, cost increases are inevitable.

SUMMARY OF THE INVENTION

An object of the present invention is to provide a vial supply apparatus that can be simplified in structure and reducing in manufacturing cost.

To achieve this object, a vial supply apparatus of the present invention comprises: a vial supply part having a plurality of storage portions which store vials having different heights according to size, each storage portion comprising a partition wall, a rotatable endless member disposed at a predetermined interval from the partition wall, partitioning members disposed at predetermined intervals on the endless member, endless member driving means for driving the endless member to rotate, and a supply port for dispensing a vial stored between adjacent partitioning members; a chute portion for dropping the vial dispensed from the supply port such that an opening of the vial faces upward; a robot arm for holding the vial supplied from the chute portion; and an adjustment table disposed below the robot arm, for adjusting an opening height of the vial supplied from the chute portion in accordance with the height of the vial.

In this vial supply apparatus, the adjustment table preferably receives the vial from the chute portion after moving to a substantially upper end position.

Further, upon reception of the vial from the chute, the adjustment table is preferably lowered such that the opening heights of the vials having different heights match, whereupon the vial is held by the robot arm.

Further, vial detection means for detecting the vial is preferably disposed in a standby position in front of the supply port of the storage portion, the vial is detected by the vial detection means after the endless member is operated, and when no vial is detected in the standby position, the endless member driving means is operated by one more pitch.

In this case, a shortage determination means is preferably provided for determining a shortage of vials when no vial is detected in the standby position by the vial detection means a predetermined consecutive number of times.

Here, the term "a rotatable endless member disposed at a predetermined interval from the partition wall" denotes a component such as a loop-form chain or belt which is positioned parallel to the partition wall.

The term "a plurality of storage portions which store vials . . . according to size" indicates that at least two types of vials are stored separately according to type. The storage portions may be disposed adjacent to each other or in different positions.

The term "dropping the vial . . . such that an opening of the vial faces upward" indicates that the vial is supplied to the robot arm by dropping the vial such that the axial direction of the vial corresponds to the vertical direction, and such that the opening of the vial is positioned on the upper side.

"A robot arm for holding the vial" includes any aspects that are capable of holding the vial by gripping the vial.

The term "operated by one . . . pitch" denotes an operation to move a space storing the vial, which is defined by a plurality of the partitioning members, to the position of the next space in the rotation direction of the endless member.

The term "the adjustment table is lowered such that the opening heights of the vials having different heights match" indicates that the adjustment table is moved in accordance with the height of the supplied vial such that the height of the opening at the upper end of the vial, or in other words the height of the vial from the installation surface on which the device is disposed, is identical regardless of the vial size.

The term "standby position" denotes a storage space surrounded by partitioning members positioned one pitch before the supply port, from which a vial will be dropped through the supply port to the chute portion when the endless member is next operated.

The "vial detection means for detecting the vial" includes any means capable of detecting the presence or absence of the vial.

The term "when no vial is detected . . . a predetermined consecutive number of times" indicates a state in which a vial cannot be detected at least twice in a row.

In the vial supply apparatus of the present invention, the partitioning members are disposed on the endless member, which is provided at a predetermined interval from the partition wall, and one vial is disposed in each space defined by the upper and lower partitioning members, the partition wall, and the endless member. Thus, the position and direction of the vial opening can be fixed and the mechanism for supplying the vial to the robot arm may be constituted by a chute portion which allows the vial to fall naturally. As a result, there is no need to provide a complicated mechanism, and the overall constitution of the vial supply apparatus can be simplified, enabling low-cost manufacture. Further, by providing the adjustment table for aligning the upper end opening heights of the vials having different heights, the position in which the vials having different overall heights are held by the robot arm can be fixed. As a result, the transfer position to the next process can be stabilized.

Further, since the vial is received from the chute portion after the adjustment table has been moved to the substantially upper end position, the degree to which the vial jumps up after falling naturally can be suppressed.

Moreover, the vial detection means for detecting the vial in the standby position, which is to be supplied through the supply hole next, is disposed in each of the storage portions, and the vial in the standby position is detected after the previous vial has been supplied. If no vial is detected in the standby position, the endless member driving means is operated one more pitch. Thus, the vial to be supplied next can be positioned in the standby position in front of the supply port, and time loss occurring at the start of a vial supply operation can be eliminated.

Furthermore, when no vial is detected by the vial detection means a predetermined consecutive number of times, the shortage determination means determines a shortage of vials in the corresponding storage portion, and prompts an operator to replenish the vials. In so doing, time loss occurring at the start of a vial supply operation can be eliminated with certainty.

BRIEF DESCRIPTION OF THE DRAWINGS

FIG. 6 is a block diagram of control performed by a device control apparatus;

DETAILED DESCRIPTION OF THE INVENTION

Figure 1:
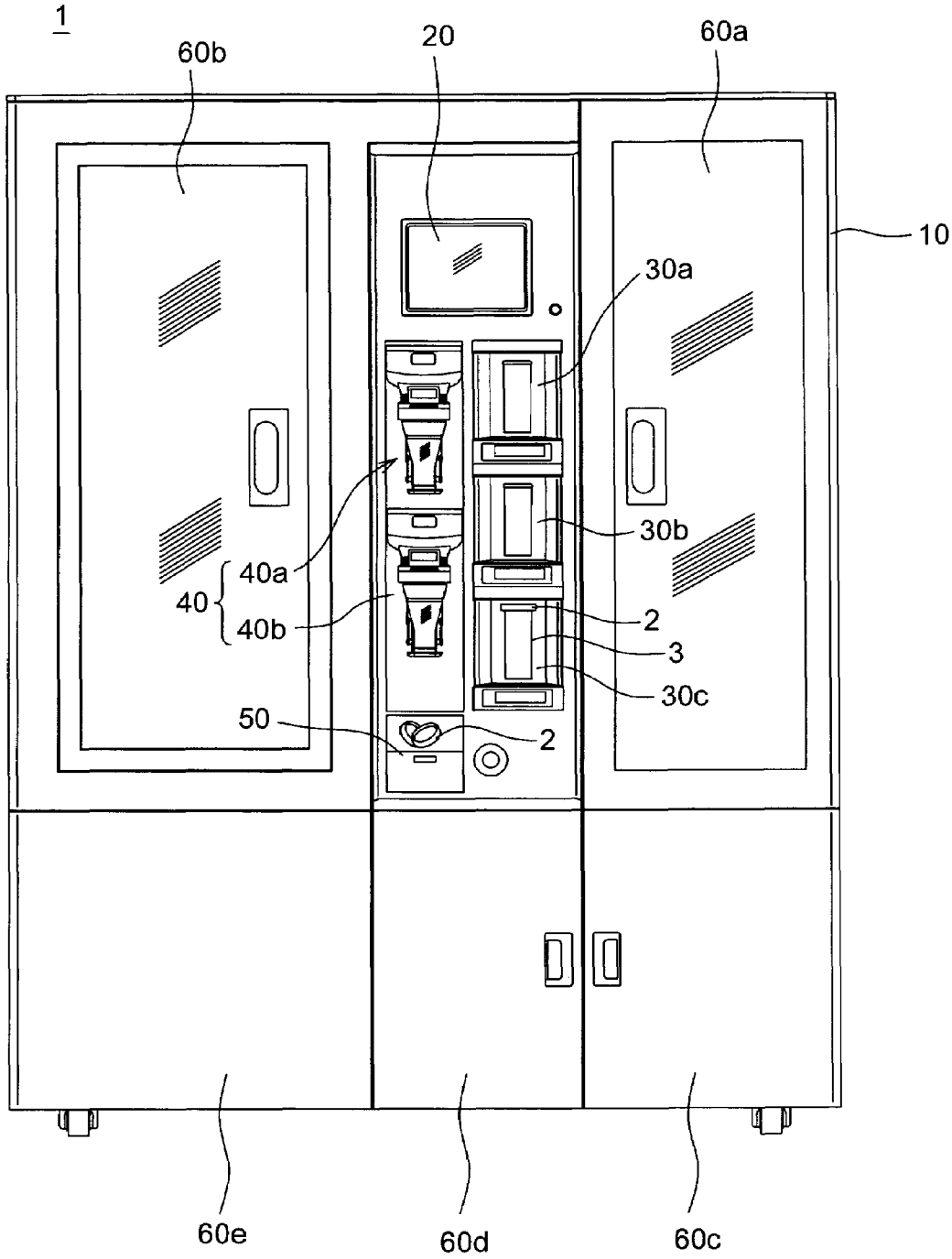
FIG. 1 is a front view of a tablet storing and dispensing apparatus according to the present invention.
Figure 2:
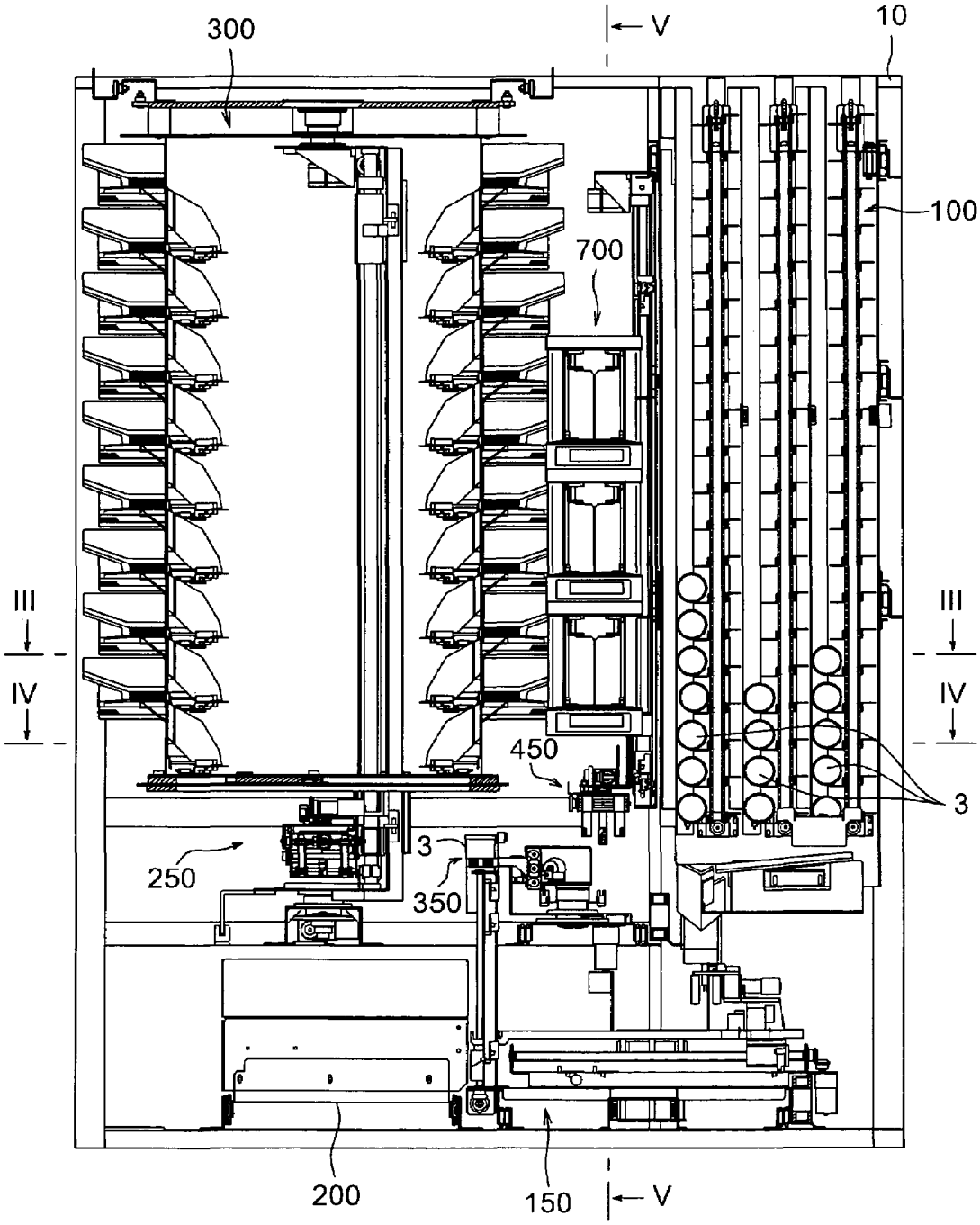
FIG. 2 is an internal front view of the tablet storing and dispensing apparatus of FIG. 1.
Figure 3:
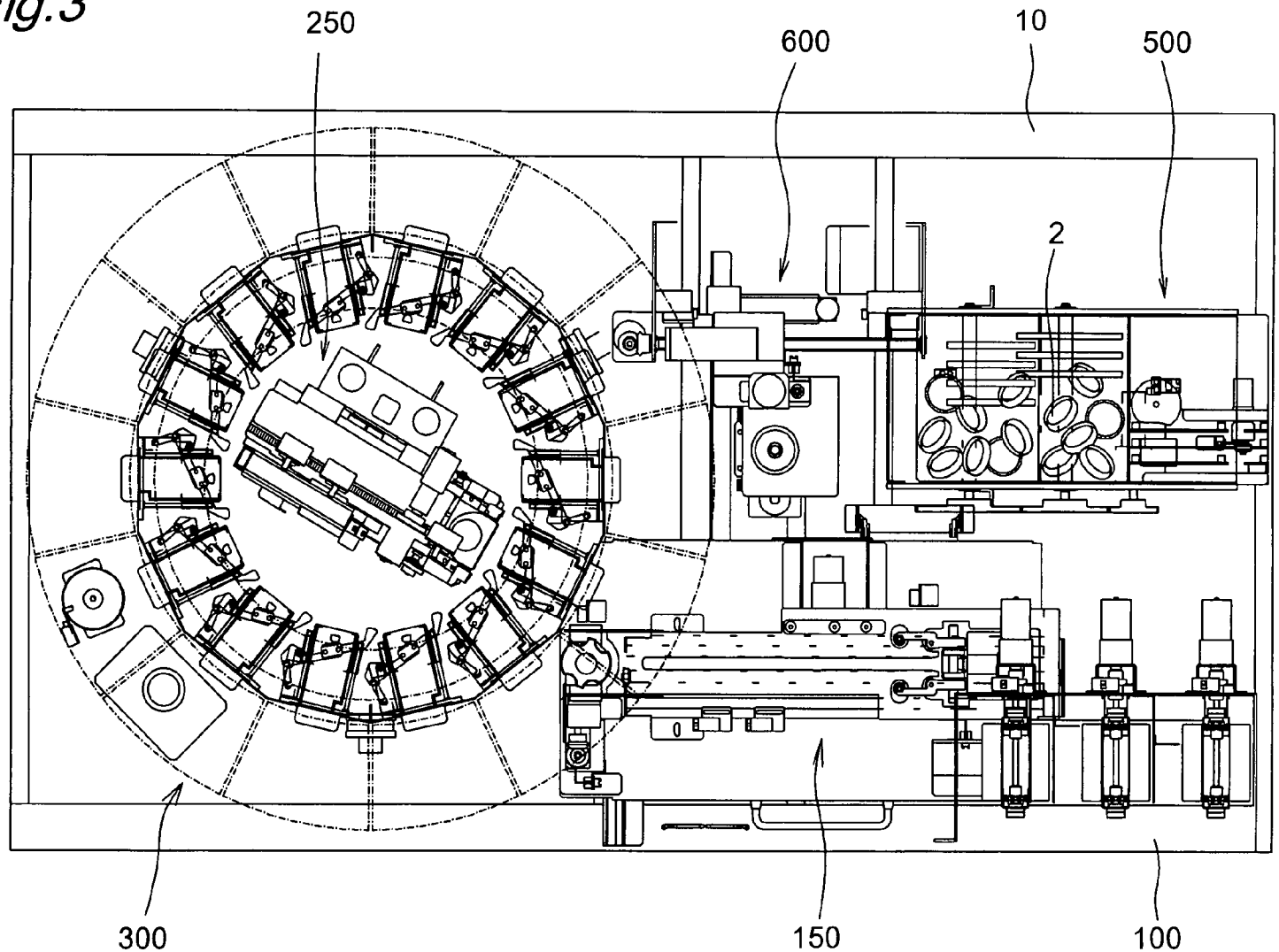
FIG. 3 is a sectional view along a line III-III of FIG. 2.
Figure 4:
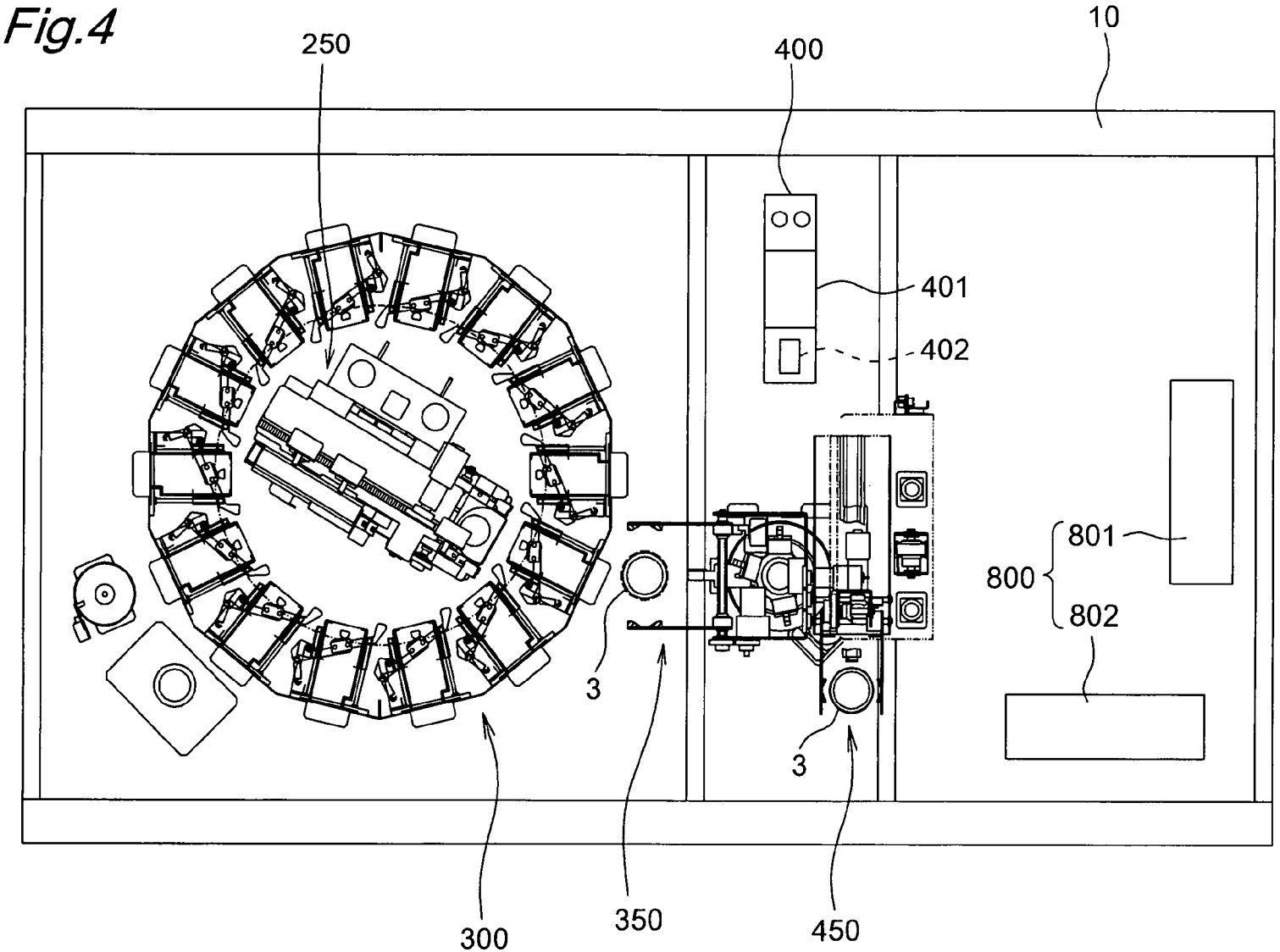
FIG. 4 is a sectional view along a line IV-IV of FIG. 2.
Figure 5:
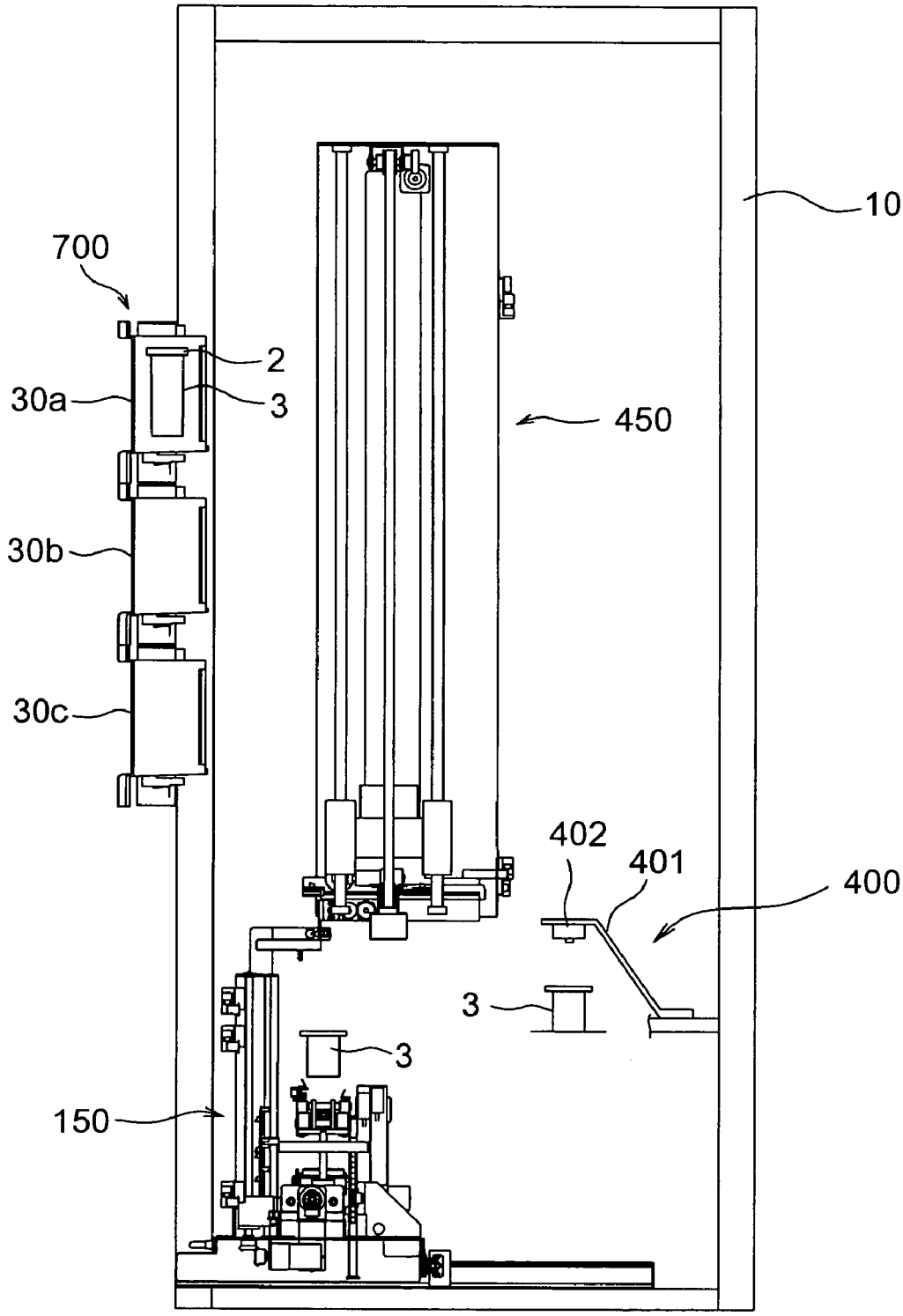
FIG. 5 is a sectional view along a line V-V of FIG. 2.

FIG. 1 is an elevation view of a tablet storing and dispensing apparatus 1 according to the invention. FIG. 2 is an elevation view of the interior of the tablet storing and dispensing apparatus 1. FIG. 3 is a cross section taken on line III-III of FIG. 2. FIG. 4 is a cross section taken on line IV-IV of FIG. 2. FIG. 5 is a cross section taken on line V-V of FIG. 2.

1. Overall Arrangement and Construction

First, a description will be given on the overall arrangement and construction of the tablet storing and dispensing apparatus 1. As shown in FIG. 1, at the upper center of a main body 10, as viewed from the front, an operation display panel 20 is provided which provides displays required for operating the tablet storing and dispensing apparatus 1. To the lower right of the operation display panel 20, three vial take-out ports 30*a*, 30*b*, and 30*c* are provided. To the lower left thereof are provided auxiliary tablet supply parts 40 (40*a*, 40*b*), under which an auxiliary cap storage part 50 is provided. The auxiliary tablet supply parts 40 store two different kinds of pyrazolone tablets respectively, and supply tablets in accordance with prescription data. The auxiliary cap storage part 50 randomly stores a large number of caps 2 and permits them to be manually taken out when necessary. At the upper right side of the tablet storing and dispensing apparatus 1, as viewed from the front, a door 60*a* is provided for replacing a vial 3. At the left side thereof a door 60*b* is provided for replacing and refilling tablets. At the bottom thereof doors 60*c*, 60*d*, and 60*e* are also provided for maintenance.

Inside the tablet storing and dispensing apparatus 1, as shown in FIGS. 2, 3, 4, and 5, a vial supply part 100, a labeling part 200, a tablet supply part 300, a photographing part 400, a cap supply part 500, a capping part 600, and a storage part 700 are provided. The vial supply part 100 is provided on the right side of the main body 10, as viewed from the front, as shown in FIG. 2, and stores a large number of vials 3 by size and supplies, one by one, vials 3 of a size suitable for filling tablets in accordance with prescription data. The labeling part 200 is provided at the lower center of the main body 10, as viewed form the front, and puts a label with printed prescription information on a vial 3 supplied from the vial supply part 100. The tablet supply part 300 is provided on the left side of the main body 10, and stores a large number of tablets (non-pyrazolone) by type and supplies tablets in accordance with prescription data. The photographing part 400 is provided, as shown in FIG. 4, on the center back side of the main body 10, and photographs a vial 3 from the above for audit of tablets filled into the vial 3. The cap supply part 500 is provided, as shown in FIG. 3, on the right side of the main body 10 and behind the vial supply part 100, and stores caps 2 for plugging the vials 3, and supplies the caps one by one. The capping part 600 is provided on the center back side of the main body 10, and plugs a vial 3, which is filled with tablets, with a cap 2 supplied from the cap supply part 500. The storage part 700, as shown in FIG. 5, stores vials 3 filled with tablets and plugged with a cap 2 so that they can be taken out by an operator through take-out ports 30*a*, 30*b*, and 30*c*.

The tablet storing and dispensing apparatus 1 is further provided, as shown in FIG. 2, with a first transfer robot 150, a second transfer robot 250, a third transfer robot 350, and a fourth transfer robot 450. The first transfer robot 150 is provided below the vial supply part 100, and can hold a vial 3 supplied from the vial supply part 100, transfer it leftward from the vial supply part 100 to the labeling part 200 in the horizontal direction of the main body, and transfer it upward from the labeling part 200 to the second transfer robot 250 or the third transfer robot 350. The second transfer robot 250 is provided inside the tablet supply part 300, and can hold a vial 3 delivered from the first transfer robot 150, transfer it to supply ports of the tablet supply part 300, and transfer it from the supply ports to the third transfer robot 350. The third transfer robot 350 is provided above the first transfer robot 150 in the main body 10, and can deliver, between the capping part 600 and the fourth transfer robot 450, a vial 3 delivered from the first transfer robot 150 or the second transfer robot 250. The fourth transfer robot 450 is provided above the third transfer robot 350, and can transfer a vial 3 delivered form the third transfer robot 350 upward to the storage part 700.

In the tablet storing and dispensing apparatus 1, as shown in FIG. 4, a control part 800 is provided on the right side of the main body 10. The control part 800 is, shown in FIG. 6, composed of: a personal computer (PC) 801 in which apparatus control applications are installed; and a device controller 802 composed of a micro computer and the like. The PC 801 is connected to a host computer 900 installed in a hospital or a drug store, and receives inputted data such as prescription data and the like. The PC 801 is also connected to the operation display panel 20, and outputs display information required for the operation of the tablet storing and dispensing apparatus 1 and also receives operation information inputted through the tough panel on the operation display panel 20. Furthermore, the PC 801 is connected to a digital camera provided in the photographing part 400. The device controller 802 is connected to sensors and driving devices of the vial supply part 100, the labeling part 200, the tablet supply part 300, the cap supply part 500, the capping part 600, and the storage part 700 so as to drive and control these parts. Moreover, the device controller 802 is connected to sensors and driving devices of the first transfer robot 150, the second transfer robot 250, the third transfer robot 350, and the fourth transfer robot 450 so as to drive and control these parts.

Next, a vial supply apparatus constituted by the vial supply part 100 and first transfer robot 150, and a labeling apparatus constituted by the first transfer robot 150 and labeling part 200, in the tablet storing and dispensing apparatus 1 having the overall constitution described above, will be described in further detail. Note that the other parts are not directly related to the present invention, and hence description thereof has been omitted.

2. Constitution of Vial Supply Part 100

Figure 7:
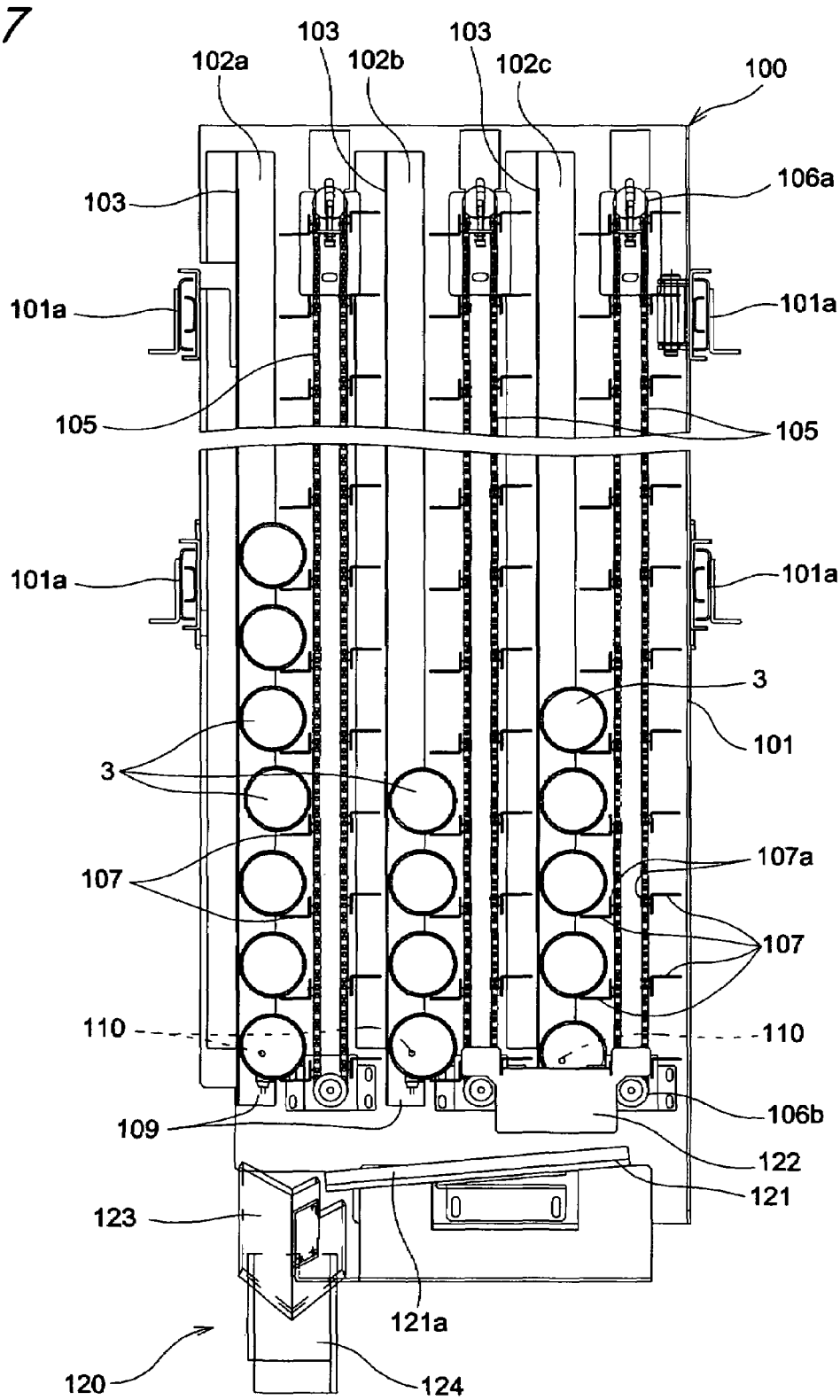
FIG. 7 is a front view of a vial supply part.
Figure 8:
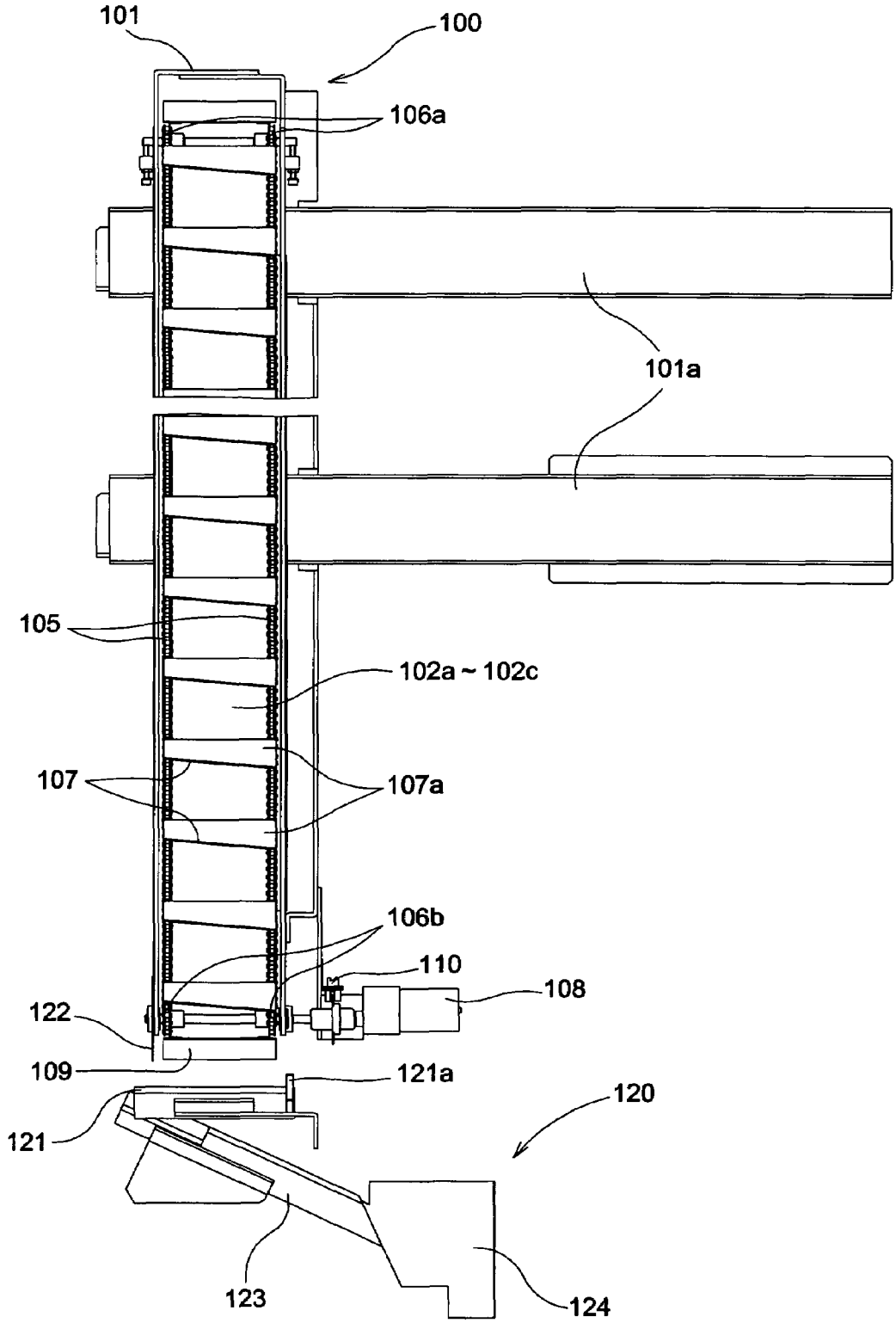
FIG. 8 is a vertical sectional view of the vial supply part.
Figure 9:
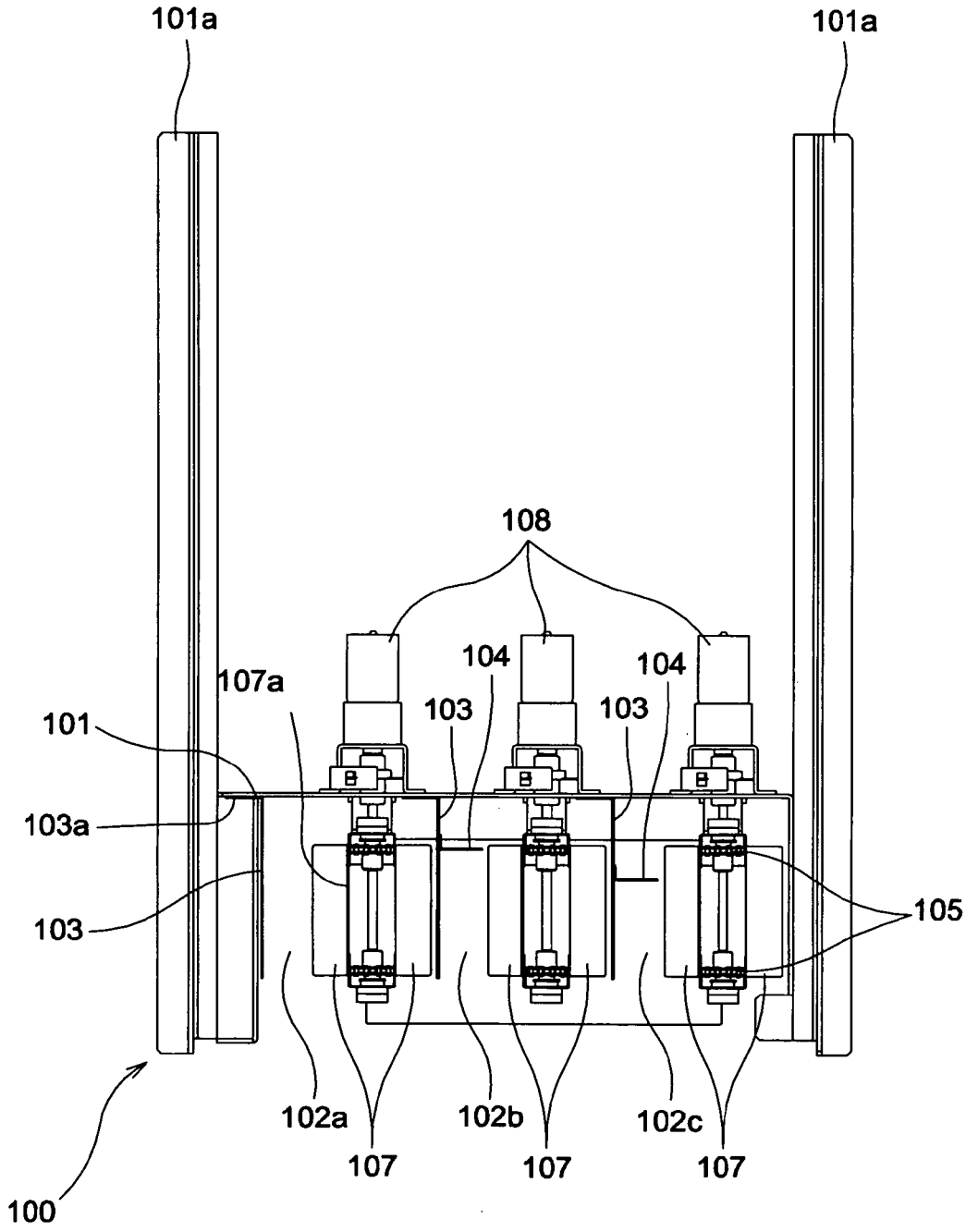
FIG. 9 is a plan view of the vial supply part.

As shown in FIGS. 7, 8, and 9, the vial supply part 100 constituting the vial supply apparatus of the present invention comprises a casing 101 having an opening on a front surface side, and comprises in its interior three storage portions 102*a*, 102*b*, 102*c* each having a partition wall 103, an endless member 105, a plurality of partitioning members 107 provided on the endless member 105, and a rotation driving apparatus serving as endless member driving means. Vials 3 having respectively different overall heights are stored according to size in each of the storage portions 102*a* to 102*c*. Note that the reference symbol 101*a* in the drawing denotes a guide frame for pulling the casing 101 forward during maintenance.

The partition wall 103 is positioned parallel to the side face of the casing 101 and extends in a vertical direction. A fixing portion 103*a* for fixing the partition wall 103 to the back surface of the casing 101 is formed on the rear end of the partition wall 103 to form an L-shape. The partition wall 103 is provided with a positioning piece 104 for positioning the rear end of the vial 3 such that the front ends of all of the vials 3 having different sizes (heights) are coplanar within the casing 101. Note that in this embodiment, the vials 3 having the greatest overall height are stored in the left side storage portion 102*a*, the vials 3 having an intermediate height are stored in the middle storage portion 102*b*, and the vials 3 having the lowest overall height are stored in the right side storage portion 102*c*. The casing 101 is formed with a sufficient depth to be able to store the vials 3 having the greatest overall height. Accordingly, the storage portion 102*a* is not provided with the positioning piece 104.

The endless member 105 is constituted by chains, which are wrapped around an upper/lower pair of gears 106*a*, 106*b* to form a loop shape in which one side portion extends parallel to the partition wall 103 with a predetermined gap therebetween. In this embodiment, the endless member 105 constituted by the chains and the gears 106*a*, 106*b* are provided in front/rear pairs in each of the storage portions 102*a* to 102*c*. The front and rear gears 106*a*, 106*a* disposed on the upper side and the front and rear gears 106*b*, 106*b* disposed on the lower side are respectively fixed to an identical rotary shaft. Note that a belt may be applied to the endless member 105 instead of the chains, and pulleys may be used instead of the gears 106*a*, 106*b*.

The partitioning members 107 are used to define spaces at predetermined intervals between the partition wall 103 and endless member 105 which are capable of storing one vial 3 each. An attachment portion 107*a* for attaching the partitioning member 107 to the endless member 105 is formed at one end of each partitioning member 107 to form an L-shape. To prevent the vials 3 from falling off the front end of the partitioning member 107 due to vibration or the like, the partitioning member 107 is fixed to the front and rear endless members 105, 105 so as to incline downward toward the rear side.

The aforementioned rotation driving apparatus is constituted by the gears 106*a*, 106*b* and an endless member drive motor 108. An output shaft of the endless member drive motor 108 is fixed to the rotary shaft joined to the lower side pair of gears 106*b*, 106*b* from among the gears 106*a*, 106*b*, and thus the endless member drive motor 108 drives the pair of endless members 105, 105 to rotate synchronously. The movement distance of the endless member 105 produced by this drive operation is set by a position detection sensor such as a limit switch, not shown in the drawing, such that the plurality of spaces defined by the plurality of partitioning members 107 move by a single pitch.

The lower end portion of the storage portions 102*a* to 102*c* constituted in this manner, at which the endless member 105 turns and moves upward, forms a supply port 109 for supplying the vial 3 to a chute portion 120 to be described below. In each storage portion 102*a* to 102*c* of this embodiment, an infrared sensor 110 serving as a vial detection means for detecting the presence of the vial 3 is disposed in a standby position in which the next vial 3 to be supplied through the supply port 109 is stored, or in other words in the space between the pair of partitioning members 107, 107 positioned one pitch before the supply port 109.

The chute portion 120 is disposed at the lower end of the vial supply part 100 for receiving the vial 3 supplied through the supply port 109, dropping the vial 3 such that the opening of the vial 3 faces upward, and supplying the vial 3 thus to the first transfer robot 150 to be described below. In the vial supply part 100 of this embodiment, the partitioning members 107 are disposed on the endless member 105, which is provided parallel to the partition wall 103, and one vial 3 is provided in each of the spaces defined by the upper and lower partitioning members 107, 107, the partition wall 103, and the endless member 105. Therefore, the opening of the vial 3 can be positioned in a fixed direction. Accordingly, the mechanism for supplying the vial 3 to the first transfer robot 150 can be constituted by the chute portion 120 which allows the vial 3 to fall naturally. In other words, simply by storing the vial 3 between adjacent partitioning members 107, 107 such that the opening of the vial 3 is positioned on the front surface side, the vial 3 can be supplied to the first transfer robot 150 with its opening facing upward without the need for a complicated mechanism. As a result, the overall constitution of the vial supply apparatus can be simplified. More specifically, the chute portion 120 of this embodiment is constituted by a vial rolling path 121, a chute 123, and a vial drop/supply path 124.

The vial rolling path 121 receives the vials 3 that are dropped through each of the supply ports 109, and supplies the vials 3 to the chute 123 by rolling the vials 3 circumferentially along an incline. The vial rolling path 121 is disposed laterally so as to be positioned below each supply port 109 of the horizontally aligned storage portions 102*a* to 102*c*, and inclined downward toward the storage portion 102*a* (the chute 123). An upwardly projecting stopper piece 121*a* is provided on both the front and rear edges of the vial rolling path 121. Note that in this embodiment, a guide wall 122 is provided so as to hang down from the front surface of the storage portion 102*c* storing the smallest vials 3, which jump up by a large distance when dropped, and a cushioning member (not shown) made of sponge and a resin sheet is provided on the vial rolling path 121.

The chute 123 receives the vial 3 supplied from the vial rolling path 121, and supplies the vial 3 to the vial drop/supply path 124 by sliding the vial 3 axially along an incline extending to the back surface side. The chute 123 is positioned substantially directly below the storage portion 102*a*, and has a V-shaped cross-section which is inclined toward the back surface side. A similar cushioning member (not shown) to that of the vial rolling path 121 is provided on the upper side part of the chute 123 which receives the vial 3 that is supplied from the vial rolling path 121 and the storage portion 102*a*.

The vial drop/supply path 124 is a tubular member which receives the vial 3 supplied from the chute 123, changes the direction of the vial 3 such that the axial direction of the vial 3 matches the vertical direction, and drops the vial 3.

The vial supply part 100 constituted in this manner is operated by a device control apparatus 802 serving as supply part control means, vial selection means, and shortage determination means. Control of the vial supply part 100 by the device control apparatus 802 will now be described in detail.

Figure 10:
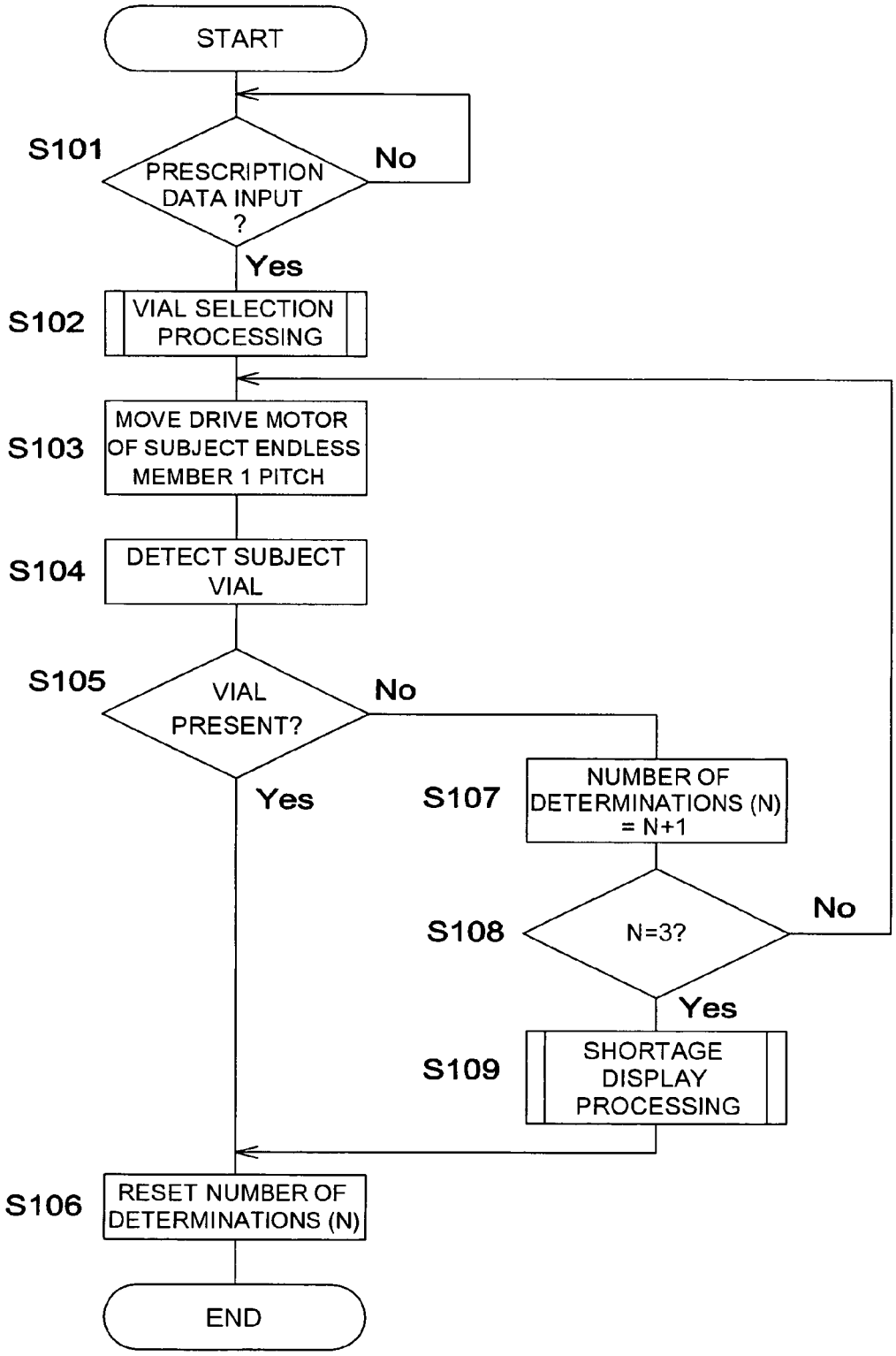
FIG. 10 is a flowchart illustrating control of the vial supply part by the device control apparatus.

As shown in FIG. 10, in a first step S101, the device control apparatus 802 waits for the input of prescription data from a host computer 900. When the prescription data are input, the routine advances to a step S102.

In the step S102, selection processing is executed to select the vial 3 which has the most suitable size on the basis of the size of the tablets specified by the input prescription data, the number of prescribed tablets, and so on.

Next, in a step S103, the endless member drive motor 108 of the storage portion 102*a* to 102*c* storing the selected vial 3 is operated, and the storage spaces defined by the pairs of partitioning members 107 are moved by a single pitch. As a result, one vial 3 is supplied to the chute portion 120 through the supply port 109, and the chute portion 120 supplies the vial 3 to the first transfer robot 150 with its opening facing upward by allowing the vial 3 to fall naturally.

Next, in a step S104, the infrared sensor 110 detects the presence or absence of the vial 3 to be supplied with the next single-pitch movement. When the vial 3 is determined to be present in a step S105, the routine advances to a step S106, and when the vial 3 is determined to be absent in the step S105, the routine advances to a step S107.

In the step S106, the number of times (N) the vial 3 has been determined to be absent is reset, and control of the vial supply part 100 is terminated.

In the step S107, 1 is added to the number of times (N) the vial 3 has been determined to be absent, and in a step S108, a determination is made as to whether or not the number of determinations (N) has reached 3. When the number of determinations (N) reaches 3, this indicates that there is a shortage of vials 3 in the subject storage portion 102*a* to 102*c*, and hence a shortage is determined and the routine advances to a step S109, where an operator is informed of the shortage by stopping the entire apparatus and performing shortage display processing on the operation/display panel 20. The routine then advances to the step S106. If, on the other hand, the number of determinations (N) has not reached 3, the routine returns to the step S103, where the subject endless member drive motor 108 is operated one more pitch. In other words, the detection processing of the step S104 is performed every time the endless member drive motor 108 is operated, and is performed until the vial 3 is determined to be present or until a shortage of the vials 3 is determined. Note that the number of determinations (N) corresponding to a shortage is not limited to 3, and may be modified as desired.

Hence, in the vial supply part 100 of the present invention, the presence of the vial 3 in the standby position is detected when the endless member 105 is operated, and when the vial 3 is determined to be absent, the endless member 105 is moved one more pitch by the endless member drive motor 108. When a shortage of the vials 3 is determined, the operator is informed thereof, and hence the vial supply part 100 is kept on standby at all times so that the vial 3 can be supplied simply by moving the endless member 105 by a single pitch. As a result, time loss generated at the start of the operation to supply the vial 3, or in other words when medicine is prescribed, can be eliminated.

3. Constitution of First Transfer Robot 150

Figure 11:
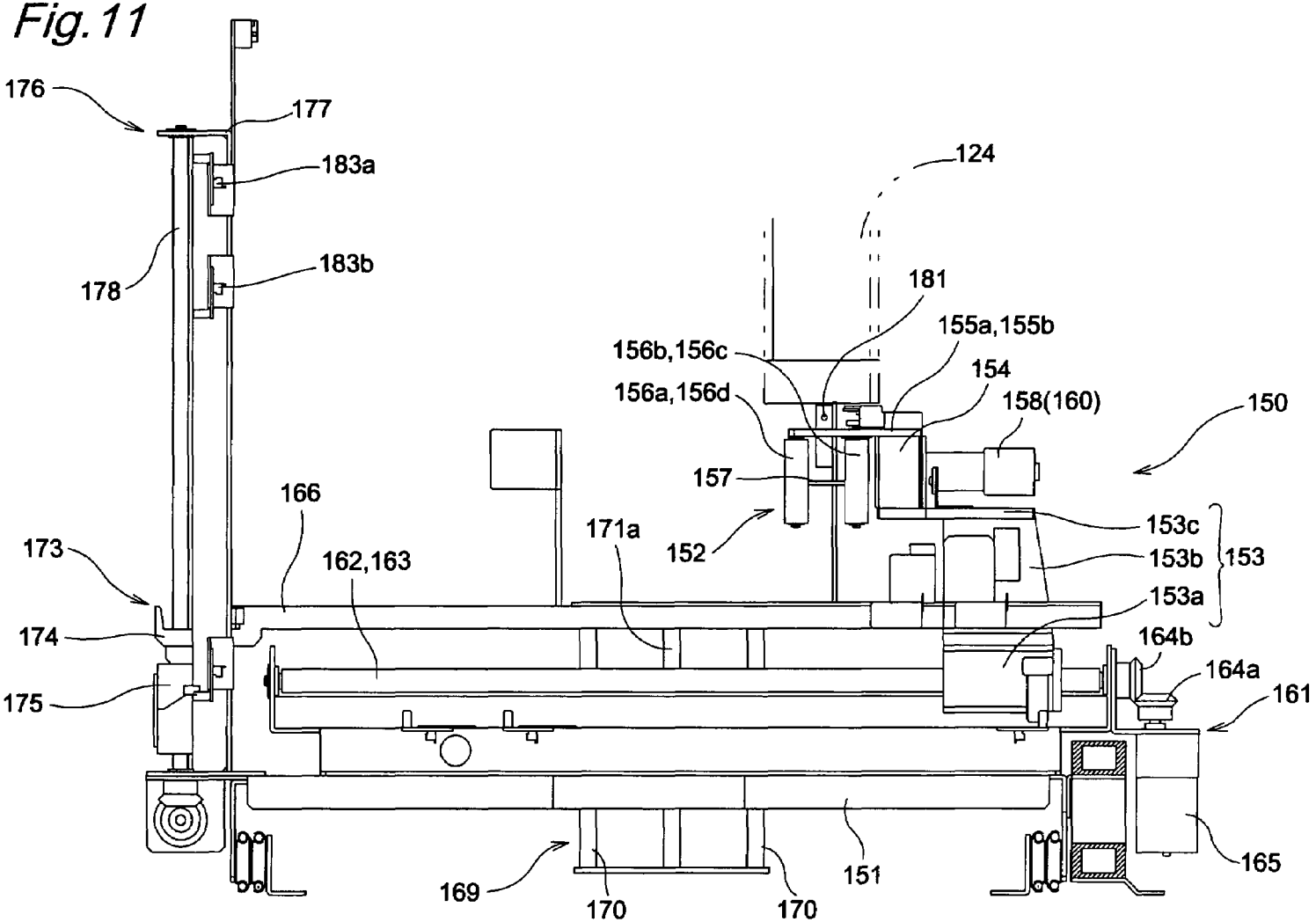
FIG. 11 is a front view of a first transfer robot.
Figure 12:
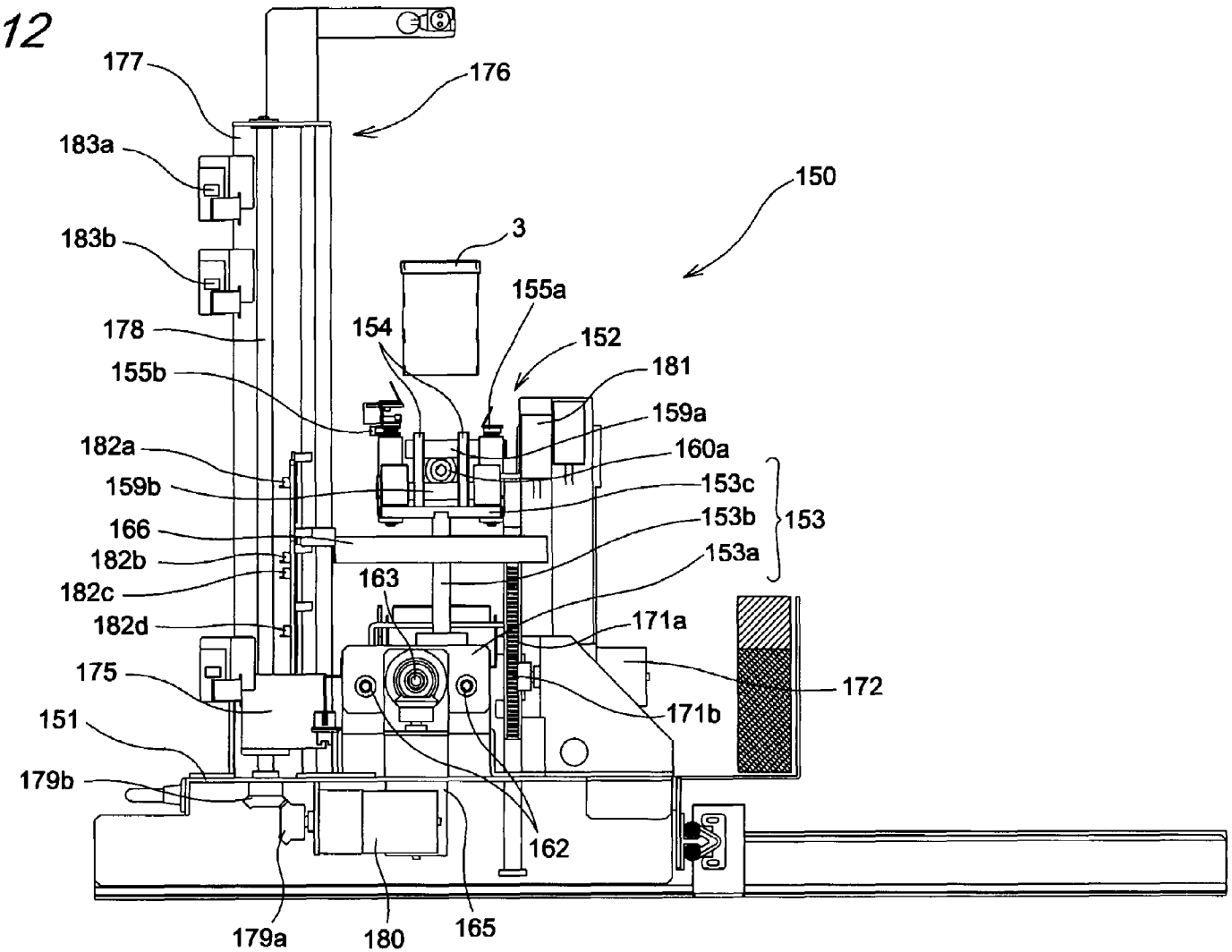
FIG. 12 is a right side view of the first transfer robot.
Figure 13:
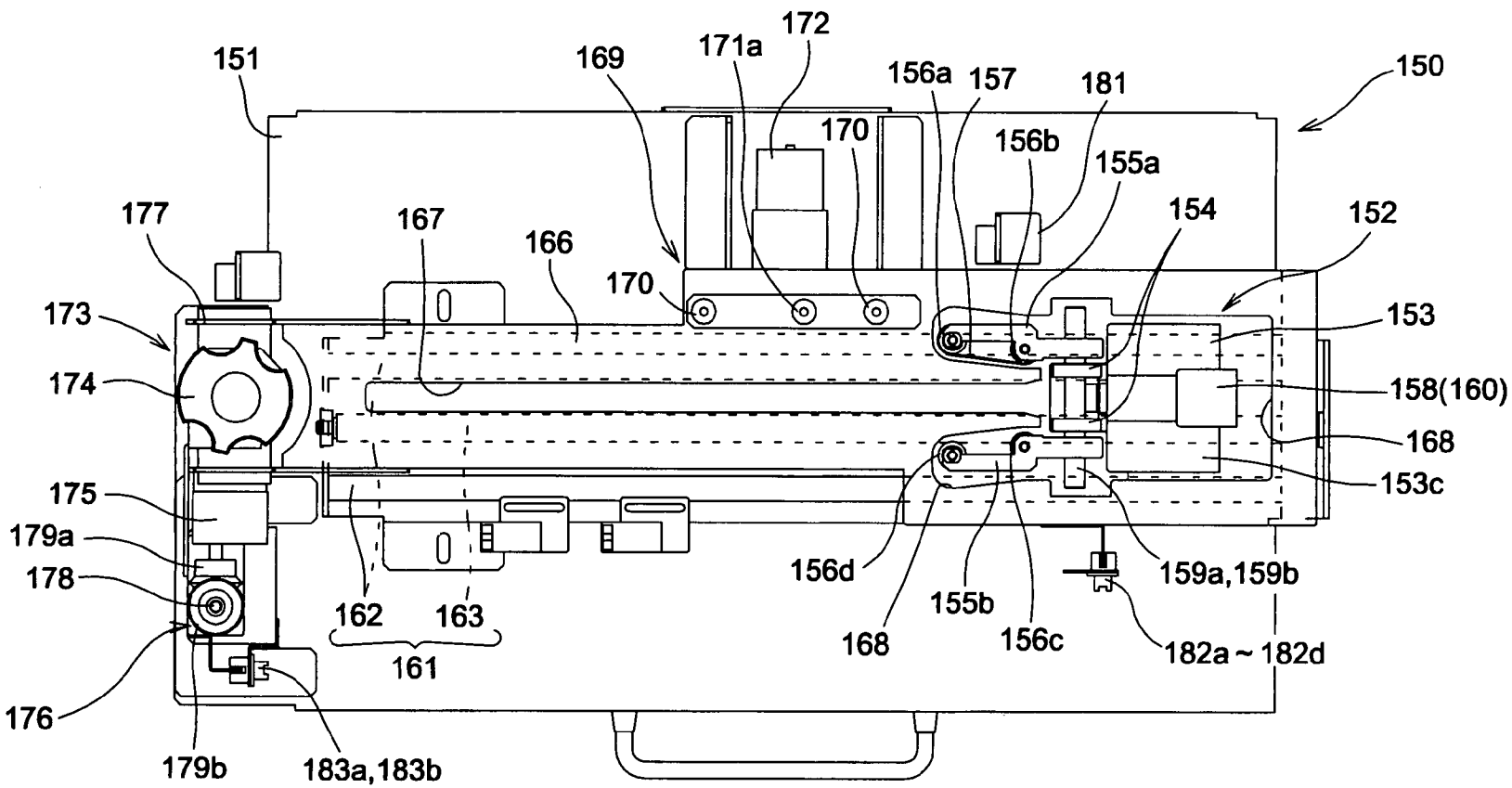
FIG. 13 is a plan view of the first transfer robot.

The first transfer robot 150, which constitutes the vial supply apparatus and labeling apparatus of the present invention, receives the vial 3 supplied from the chute portion 120, and supplies the vial 3 to a second transfer robot 250 or a third transfer robot 350 shown in FIG. 2 via the labeling part 200. As shown in FIGS. 11, 12, and 13, the first transfer robot 150 comprises a base 151 for pulling the entire first transfer robot 150 forward during maintenance, and a robot arm 152, a parallel moving apparatus 161, an adjustment table 166, an adjustment table moving apparatus 169, an elevator table 173, and an elevator driving apparatus 176 are disposed on the base 151.

As shown in FIG. 11, the robot arm 152 holds the vial 3 supplied from the chute portion 120, and is constituted by a pair of arms 155*a*, 155*b* disposed on a moving block 153, and an arm driving apparatus 158 for driving the arms 155*a*, 155*b*.

The moving block 153 is constituted by a base portion 153*a*, a vertical wall 153*b* which projects upward from the center of the base portion 153*a*, and an arm attachment portion 153*c* extending parallel to the base portion 153*a* from the upper end of the vertical wall 153*b*. A pair of guide holes and a screw hole, none of which are shown in the drawing, are provided in the base portion 153*a*. A bearing portion 154 is provided so as to project from the arm attachment portion 153*c*.

The parallel moving apparatus 161, which moves the entire robot arm 152 by moving the moving block 153 to the left side of the horizontal direction, is constituted by guide shafts 162 inserted through the guide holes in the base portion 153*a* of the moving block 153, a ball screw 163 disposed between the guide shafts 162 and screwed into the screw hole in the base portion 153*a*, gears 164*a*, 164*b* for rotating the ball screw 163, and a drive motor 165.

As shown in FIGS. 12 and 13, the arms 155*a*, 155*b* are positioned on the outer peripheral portion of the vial 3 and disposed at the respective ends of a pair of racks 159*a*, 159*b* disposed on the bearing portion 154 so as to constitute the arm driving apparatus 158 to be described below. First through fourth support rollers 156*a*, 156*b*, 156*c*, 156*d* for supporting the outer peripheral surface of the vial 3 in a lengthwise direction are disposed rotatably on the arms 155*a*, 155*b*. An endless member 157 constituted by a rubber ring is wrapped around the first and second support rollers 156*a*, 156*b* disposed rotatably on the arm 155*a*, from among the support rollers 156*a* to 156*d*. Here, the vial 3 that is supported by the support rollers 156*a* to 156*d* is rotated by vial rotating means disposed on the labeling part 200 to be described below (see FIG. 15) such that a label 4 comes into contact with the first, second, third, and fourth support rollers 156*a* to 156*d* in sequence. Also, the label 4 is supplied to the vial 3 so as to be positioned in front of the rotation direction of the vial 3 at the first support roller 156*a*.

The arm driving apparatus 158 for driving the pair of arms 155*a*, 155*b* is constituted by the pair of racks 159*a*, 159*b*, which are supported by the bearing portion 154 and have ends which protrude in respectively opposite directions (forward and rearward), and a drive motor 160 having a gear 160*a* for rotating the mutually opposing teeth of the racks 159*a*, 159*b*, which is disposed on an output shaft thereof. When the gear 160*a* rotates forwardly, the racks 159*a*, 159*b* move in a direction which causes the protruding tip ends thereof to retreat from each other, and as a result, the arms 155*a*, 155*b* approach each other. When the gear 160*a* rotates reversely, the racks 159*a*, 159*b* move in a direction which causes the protruding tip ends thereof to approach each other, and as a result, the arms 155*a*, 155*b* move away from each other.

As shown in FIGS. 11 and 12, the adjustment table 166 is disposed below the arms 155*a*, 155*b* serving as the robot arm 152 so as to be capable of moving in a vertical direction, and is constituted by a plate extending from a position to which the vial 3 falls from the chute portion 120, which serves as a start position of the robot arm 152, to the labeling part 200 which serves as a movement end position. As shown in FIG. 13, a long groove 167 for accommodating the vertical wall 153*b* of the moving block 153 is provided in the adjustment table 166 so as to extend in the lengthwise direction. Further, an insertion hole 168 into which the moving block 153 and the support rollers 156*a* to 156*d* can be inserted is provided at the start position.

As shown in FIGS. 11 and 12, the adjustment table moving apparatus 169 for raising and lowering the adjustment table 166 in the vertical direction is constituted by a pair of guide shafts 170 inserted through guide holes that are provided substantially in the center of the back surface side of the adjustment table 166, a ball screw 171*a* disposed between the guide shafts 170 and screwed into a screw hole that is provided in the adjustment table 166, a gear 171*b* for rotating the ball screw 171*a*, and a drive motor 172.

As shown in FIGS. 11 and 12, the elevator table 173 is provided at the movement end position of the robot arm 152, and is constituted by a tray portion 174 for receiving the vial 3 that is transported by the robot arm 152, and an attachment table 175 to which the tray portion 174 is attached.

As shown in FIG. 12, the elevator driving apparatus 176 for raising and lowering the attachment table 175 is constituted by a support pillar 177 extending to a transfer position to the second transfer robot 250 on the upper side thereof, a ball screw 178 disposed rotatably so as to extend between the upper and lower ends of the support pillar 177 and screwed into a screw hole provided in the attachment table 175, gears 179*a*, 179*b* for rotating the ball screw 178, and a drive motor 180.

Further, as shown in FIG. 11, an infrared sensor 181 serving as detection means for determining that the vial 3 has been supplied to the back surface side of the start position is provided on the first transfer robot 150. As shown in FIG. 12, four limit switches 182*a* to 182*d* serving as elevation position detection sensors for detecting the position of the adjustment table 166 are disposed on the front surface side of the start position. The limit switch 182*a* in the uppermost position detects the reception position of the vial 3. The limit switch 182*b* positioned therebelow detects a height adjustment position when the vial 3 having the smallest overall height is to be transported. The limit switch 182*c* positioned therebelow detects a height adjustment position when the vial 3 having the intermediate overall height is to be transported. The limit switch 182*d* in the lowermost position detects a height adjustment position when the vial 3 having the greatest overall height is to be transported. Two limit switches 183*a*, 183*b* for detecting the elevation position of the elevator table 173 are disposed on the support pillar 177 in the end position. Here, the upper side limit switch 182*a* detects a transfer position to the second transfer robot 250 shown in FIG. 2, while the lower side limit switch 182*b* detects a transfer position to the third transfer robot 350.

The first transfer robot 150 constituted in this manner is operated by the device control apparatus 802 shown in FIG. 6 serving as transfer robot control means. Control of the first transfer robot 150 by the device control apparatus 802 will be described below in detail.

Figure 14:
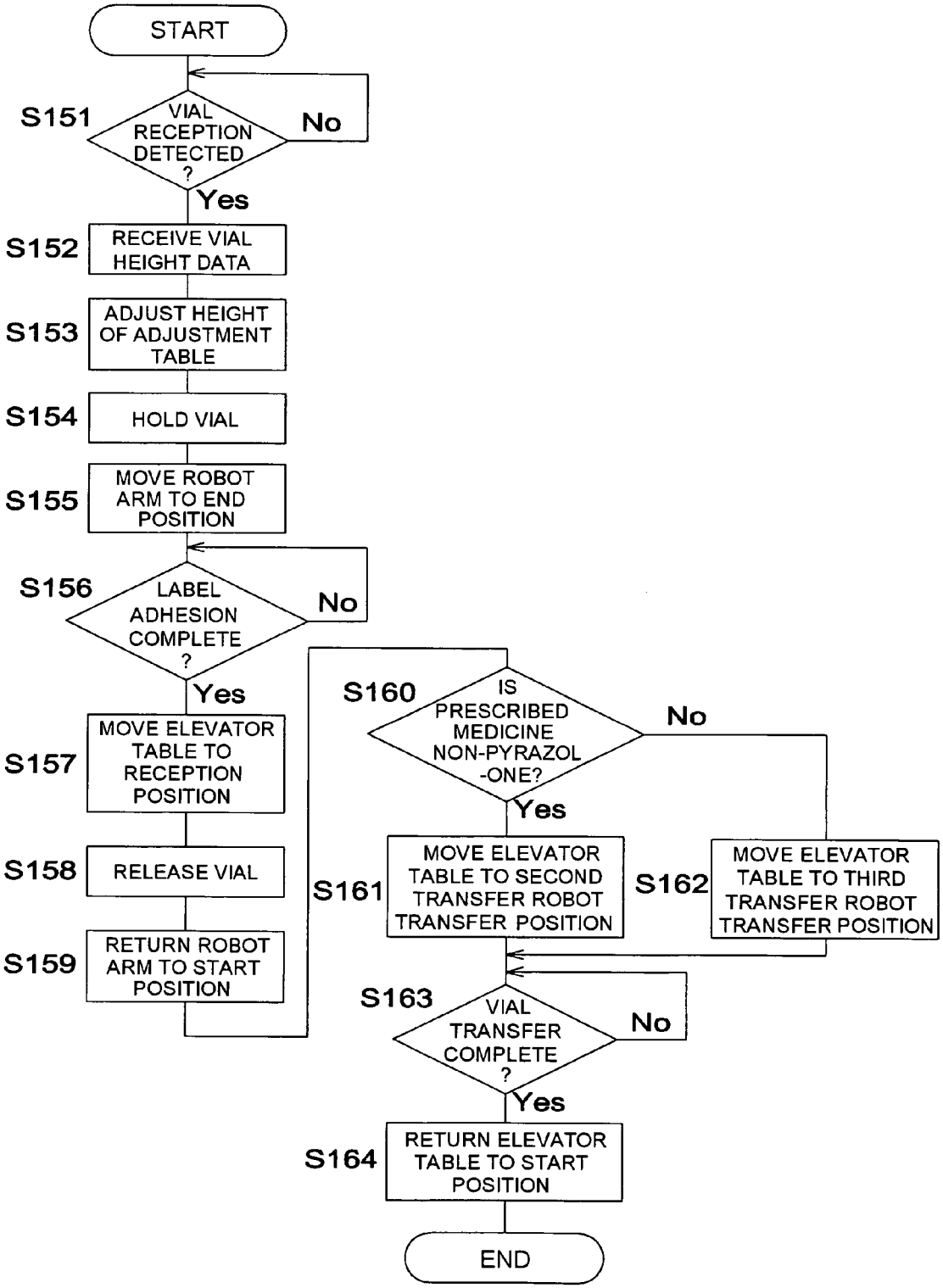
FIG. 14 is a flowchart illustrating control of the first transfer robot by the device control apparatus.

As shown in FIG. 14, in an initial step S151, the device control apparatus 802 waits for the infrared sensor 181 to detect the supply of the vial 3 from the chute portion 120 in the start position, which is the upper end position of the adjustment table 166 adjusted by the limit switch 182*a*.

When it is determined that the vial 3 has been received, height data relating to the vial 3 selected in the step S102 on the basis of the input prescription data are received (read) in a step S152, and in a step S153, the adjustment table moving apparatus 169 is operated to adjust the height of the adjustment table 166 using the limit switches 182*b* to 182*c*. As a result, the upper end positions of the differently sized vials 3 all match each other.

Next, in a step S154, the robot arm 152 is operated by the arm driving apparatus 158 to grip the vial 3, whereupon the parallel moving apparatus 161 is operated in a step S155 to move the robot arm 152 in a horizontal direction to a label affixing position, or in other words the end position.

Next, in a step S156, the device control apparatus 802 waits for the label 4 to be affixed to the outer peripheral surface of the vial 3 by the labeling part 200 to be described below, and when adhesion of the label 4 is complete, the elevator driving apparatus 176 is operated in a step S157 to raise the elevator table 173 to the transfer position (bottom) of the vial 3.

Next, in a step S158, the robot arm 152 is operated by the arm driving apparatus 158 to release the held vial 3, whereupon the parallel moving apparatus 161 and adjustment table moving apparatus 169 are operated in a step S159 to return to the start position. Note that this return operation is performed by first moving the adjustment table 166 to the lowermost position, then moving the robot arm 152 to the start position, and then moving the adjustment table 166 to the uppermost position.

Next, in a step S160, a determination is made on the basis of the prescription data as to whether or not the tablets prescribed are non-pyrazolone. When the prescribed tablets are non-pyrazolone tablets, the routine advances to a step S161, where the elevator table 173 is moved by the elevator driving apparatus 176 to a second transfer robot transfer position on the upper side. The routine then advances to a step S163. On the other hand, when the prescribed tablets are not non-pyrazolone tablets, the routine advances to a step S162, where the elevator table 173 is moved by the elevator driving apparatus 176 to a third transfer robot transfer position on the lower side. The routine then advances to the step S163.

In the step S163, the second transfer robot 250 or third transfer robot 350 holds the vial 3 and waits for the completion of transfer. When transfer is complete, the elevator table 173 is returned to the lower end start position by the elevator driving apparatus 176 in a step S164, whereupon control of the first transfer robot 150 is terminated.

Hence, the first transfer robot 150 of the present invention is constituted to move the robot arm 152 horizontally using the parallel moving apparatus 161, rather than to move the vial 3 one pitch at a time, and as a result, an improvement in the stability of the transport operation can be achieved.

Further, the first transfer robot 150 adjusts the height of the adjustment table 166 so that the upper end positions of the vials 3 having different overall heights match, and then operates the robot arm 152 to transport the vial 3. Therefore, the position in which the vial 3 is held from its upper end is constant regardless of the overall height of the vial 3, and as a result, the transfer position to the next process can be stabilized. In other words, according to this embodiment, the label affixing position in which the label 4 is affixed by the labeling part 200 to be described below is a constant distance from the upper end opening of the vial 3 regardless of the overall height of the vial 3.

Moreover, the adjustment table 166 receives the vial 3 from the chute portion 120 after being moved to the upper end position, and therefore the degree to which the vial 3 jumps up after falling naturally can be suppressed. As a result, the stability of the transfer operation from the chute portion 120 can be improved.

4. Constitution of Labeling Part 200

Figure 15:
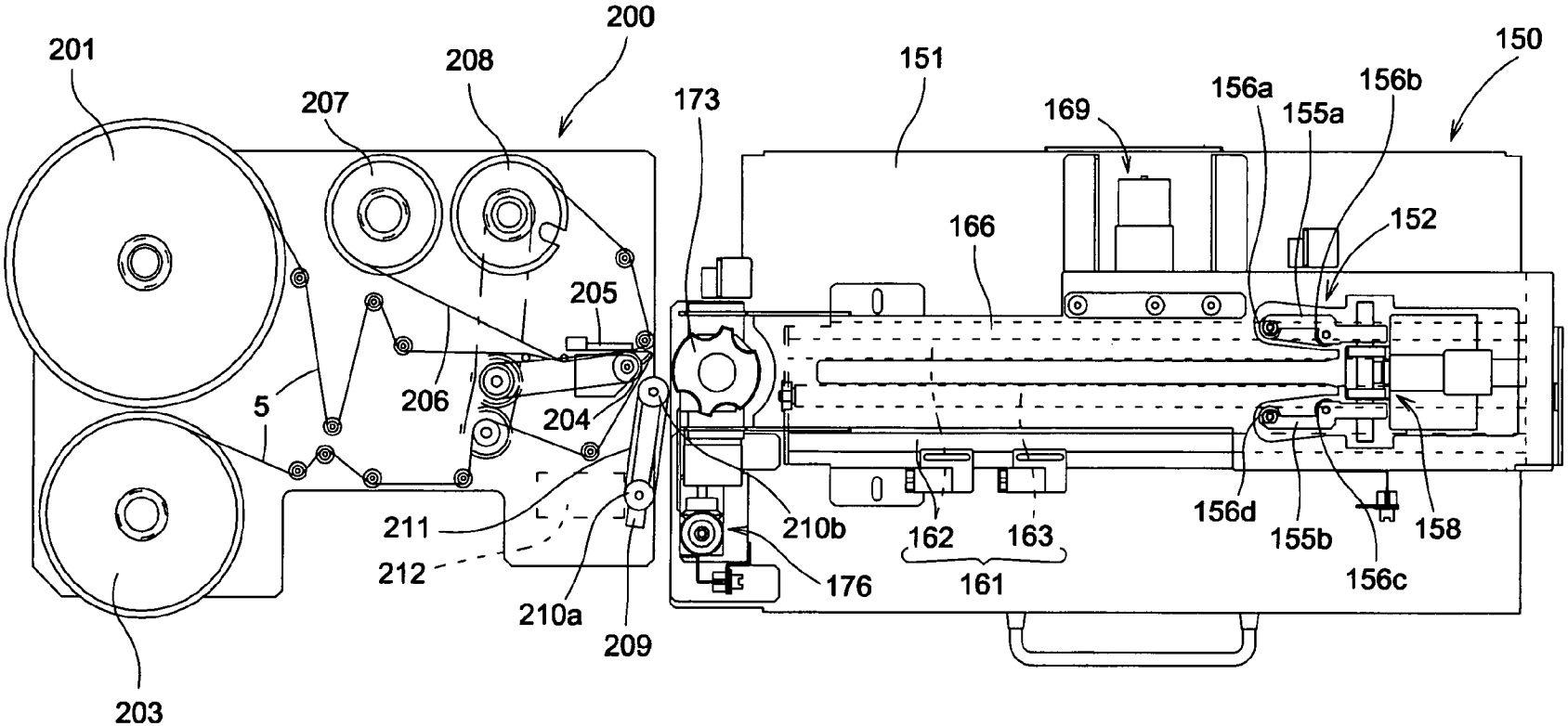
FIG. 15 is a plan view of the first transfer robot and a labeling part.
Figure 16:
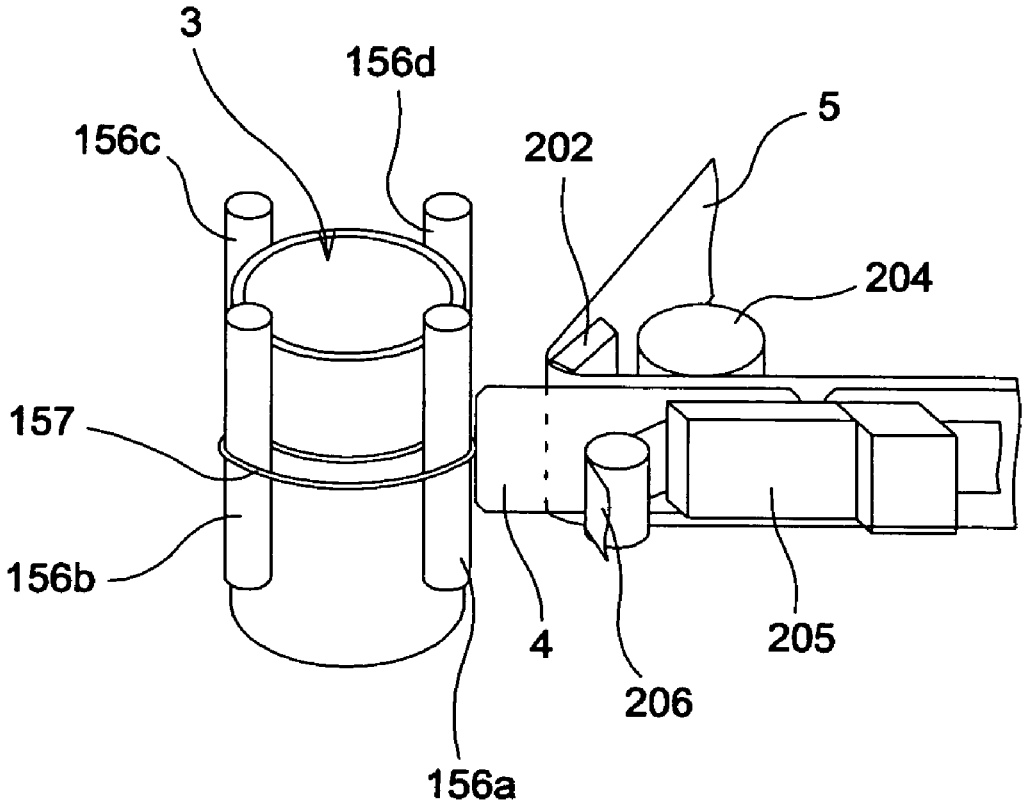
FIG. 16 is a perspective view of the main parts of FIG. 15.

As shown in FIGS. 15 and 16, the labeling part 200 constituting the labeling apparatus supplies the label 4, which is printed with a medicine name and so on, to the outer peripheral surface of the vial 3 so that the label 4 is positioned in front of the direction in which the vial 3 is rotated by vial rotating means, to be described below, at the first support roller 156*a* of the robot arm 152. The label 4 is affixed to a sheet 5 supplied by a first roller 201, and the sheet 5 is peeled away from the label 4 by switching the direction of the sheet 5 using a guide chip 202. Having been peeled away from the label 4, the sheet 5 is wound onto a second roller 203. While being supported by a backing roller 204 before the sheet 5 is peeled away, the label 4 is printed by a print head 205 through thermal transfer of a ribbon 206. The ribbon 206 is supplied from a third roller 207 and wound onto a fourth roller 208.

The labeling part 200 is also provided with the vial rotating means for rotating the vial 3, which is held by the rotatable support rollers 156*a* to 156*d*, in the direction of the first, second, third, and fourth support rollers 156*a* to 156*d*. The vial rotating means is constituted by a rotary substrate 209 which is disposed rotatably, rotary rollers 210*a*, 210*b* disposed rotatably at either end of the rotary substrate 209, a belt 211 which is wrapped around the rotary rollers 210*a*, 210*b*, and a motor 212 for rotating the rotary roller 210*a* disposed at the rotational center of the rotary substrate 209.

The labeling part 200 constituted in this manner is operated by the device control apparatus 802. More specifically, when the robot arm 152 is moved to the end position in the step S155 of the flowchart shown in FIG. 14, the label 4 is printed on the basis of the prescription data. The rotary substrate 209 is then rotated such that the front end rotary roller 210*b* comes into contact with the vial 3 that is supported rotatably by the support rollers 156*a* to 156*d*. In this state, the rotary roller 210*b* is rotated by the motor 212 via the rotary roller 210*a*, whereby the vial 3 is rotated within the support rollers 156*a* to 156*d*.

At this time, the label 4 peeled away from the sheet 5 by the guide chip 202 advances between the support rollers 156*a*, 156*d*, comes into contact with the vial 3, and thus becomes adhered to the outer peripheral surface of the vial 3 by means of an adhesive coated on the label 4. The label 4 is pressed by the first through fourth support rollers 156*a* to 156*d* in sequence so as to become firmly adhered to the entire surface of the vial 3.

Immediately after the label 4 is affixed to the vial 3, the adhesion condition is unstable, and the tip end part of the label 4 is likely to peel away from the vial 3 due to the stiffness of the label 4 itself. In this embodiment, however, the endless member 157 is wrapped around the first support roller 156*a* which the label 4 contacts first and the second support roller 156*b* which the label 4 contacts second, from among the support rollers 156*a* to 156*d* of the robot arm 152 constituting the labeling apparatus, and hence the label 4 can be affixed firmly without peeling away from the vial 3 at the tip end part thereof.

Note that the vial supply apparatus of the present invention is not limited to the embodiment described above, and may be modified in various ways.

The invention claimed is:

1. A vial supply apparatus comprising:

a vial supply part having a plurality of storage portions which store vials having different heights according to size, each storage portion comprising a partition wall, a rotatable endless member disposed at a predetermined interval from the partition wall, partitioning members disposed at predetermined intervals on the endless member, endless member driving means for driving the endless member to rotate, and a supply port for dispensing a vial stored between adjacent partitioning members;

a chute portion for dropping the vial dispensed from the supply port such that an opening of the vial faces upward;

a robot arm for holding the vial supplied from the chute portion; and an adjustment table disposed below the robot arm and configured to receive the vial from the chute portion after moving to a substantially upper end position, the adjustment table for adjusting an opening height of the vial received from the chute portion by being lowered to match the opening height of the vial with opening heights of other vials having different heights, whereupon the robot arm is arranged to hold the vial received from the chute.

2. The vial supply apparatus according to claim 1, wherein vial detection means for detecting the vial is disposed in a standby position in front of the supply port of the storage portion, the vial is detected by the vial detection means after the endless member is operated, and when no vial is detected in the standby position, the endless member driving means is operated by one more pitch.

3. The vial supply apparatus according to claim 2, further comprising shortage determination means for determining a shortage of vials when no vial is detected in the standby position by the vial detection means a predetermined consecutive number of times.

* * * * *